United States Patent [19]

Campbell

[11] Patent Number: 4,870,763

[45] Date of Patent: Oct. 3, 1989

[54] MULTI-PORT STEAM CHAMBER METERING VALVE FOR STEAM IRON

[75] Inventor: James D. Campbell, Bolingbrook, Ill.

[73] Assignee: Sunbeam Corporation, Downers Grove, Ill.

[21] Appl. No.: 231,387

[22] Filed: Jul. 22, 1988

[51] Int. Cl.[4] ..... D06F 75/18

[52] U.S. Cl. ..... 38/77.7; 38/77.83

[58] Field of Search ..... 38/77.7, 77.83, 77.81; 137/625.32

[56] References Cited

U.S. PATENT DOCUMENTS

| | | | |
|---|---|---|---|
| 2,690,623 | 10/1954 | Jepson | 38/77.7 |
| 2,805,497 | 9/1957 | Gomersall | 38/77.7 |
| 2,887,799 | 5/1959 | Kuhn et al. . | |
| 3,130,507 | 4/1964 | Hoecker . | |
| 3,136,080 | 6/1964 | Albrecht . | |
| 3,165,843 | 1/1965 | Willman . | |
| 3,263,350 | 8/1966 | Abraham . | |
| 3,889,406 | 6/1975 | Chivers et al. . | |
| 4,197,664 | 4/1980 | Hammer et al. . | |
| 4,296,560 | 10/1981 | Schwob | 38/77.83 X |

*Primary Examiner*—Andrew M. Falik

*Attorney, Agent, or Firm*—Mason, Kolehmainen, Rathburn & Wyss

[57] ABSTRACT

A variable steam flow assembly for a steam iron includes a metering valve which does not depend on axial movement of a valve member with respect to a valve seat to control the steam flow rate, as in conventional metering valves, thus allowing the steam flow rate to be more accurately controlled. The metering valve includes a cylindrical gasket having a transverse bore disposed intermediate the ends. Longitudinal bores between each end of the gasket and the transverse bore define a plurality of flow passageways through the valve. A valving member is rotatably received in the transverse bore. Rotation of the valving member allows various flow passageways to be selected. The valving member is mechanically coupled to a steam flow control knob disposed on the exterior of the steam iron housing. The steam flow control knob is provided with a plurality of detent positions to allow a finite number of flow rates to be selected. A drip tube provided at the discharge of the metering valve prevents the valve member from being in direct communication with the steam generator. This reduces the possibility of mineral deposits forming on the valve member due to spattering resulting from the boiling of water droplets in the steam generator; hence changing the flow rate. The drip tube is provided with longitudinal bores of smaller diameter than the gasket that determine the flow rate through the valve.

27 Claims, 2 Drawing Sheets

MULTI-PORT STEAM CHAMBER METERING VALVE FOR STEAM IRON

RELATED APPLICATION

A steam iron is disclosed in copending application Ser. No. 947,019, filed on Dec. 29, 1986, U.S. Pat. No. 4,748,755 which is assigned to the same assignee of the present invention.

BACKGROUND OF THE INVENTION

1. Field of the Invention

This invention relates to a variable steam flow assembly for a steam iron and more specifically to a variable steam flow assembly which allows an operator to select from a finite number of steam flow rates which can be more accurately controlled than valves used in conventional steam irons and is less susceptible to mineral deposits.

2. Description of the Prior Art

Steam irons having variable steam flow rates are known in the art. Examples of such steam irons are disclosed in the following U.S. Pat. Nos.: 2,887,799; 3,130,507; 3,136,080; 3,165,843 and 3,263,350. In general, these irons have a water reservoir which communicates with a steam generator by way of a metering valve. Such metering valves consist of an orifice or valve seat which cooperates with a valve rod, generally tapered or stepped at one end, to control the flow of water from the water reservoir to the steam generator. The valve rod is generally connected to a mechanical linkage which, in turn, is connected to an actuator located on the outside of the iron housing to allow the operator to control the axial movement of the metering rod with respect to the valve seat to obtain the desired steam flow rate. With such valves, the position of the valve rod with respect to the valve seat controls the steam flow rate. The valve rod may also be fully inserted into the valve seat to close off the water supply to the steam generator such that the iron can be used as a dry iron.

However, with such valves, it is relatively difficult to accurately control the axial position of the valve rod with respect to the valve seat, thus making it difficult to accurately control the steam flow rate. Such valves are also subject to inaccuracies in the steam flow rate due to manufacturing tolerances in the valve rods and the valve seats. Moreover, it is difficult to control the flow rate with such metering valves because of the exposure of the valve rod and valve seat to the steam generator making it susceptible to mineral deposits due to spattering resulting from the boiling of water droplets in the steam generator.

Some prior art steam irons have attempted to provide means for self-cleaning, of an iron. For example, U.S. Pat. No. 3,889,406 discloses a metering valve which includes a valve seat and a tapered valve rod mounted to allow the tapered end of the valve rod to be completely spaced apart from the valve seat to allow relatively large quantities of water to flow through the valve and into the steam generator to flush out carbonized lint and loose residues in the soleplate. However, such a self-cleaning feature is unlikely to clean all mineral residues from the metering valve itself.

In U.S. Pat. No. 4,197,664, a metering valve having a valve seat and a metering rod tapered at one end is allowed to extend all the way through the valve seat to allow residues formed in the valve seat to be scraped off. However, as heretofore stated, it is difficult to control the flow rate of such a valve because of the difficulty in controlling the axial position of the valve rod with respect to the valve seat.

SUMMARY OF THE INVENTION

It is an object of the present invention to provide a variable steam flow iron which overcomes the problems of the prior art.

It is a further object of the present invention to provide a variable steam flow iron in which the steam flow rate can be accurately controlled.

It is yet another object of the present invention to provide a variable steam flow iron wherein the flow rate is not as dependent upon the tolerance of the valve parts as conventional irons.

It is yet another object of the present invention to provide a variable steam flow iron which is not as susceptible to mineral deposits as conventional variable steam flow irons.

Briefly, the present invention relates to a variable steam flow iron having a water reservoir which communicates with a steam chamber by way of a metering valve which includes a cylindrically shaped gasket having a transverse bore disposed intermediate the ends for receiving a rotatably mounted valve member. The gasket is provided with one or more axial bores between the ends of the gasket and the transverse bore which define a plurality of flow paths through the gasket. The valve member contains a plurality of peripherally spaced fingers at one end for selectively opening and closing the axial bores to define a plurality of flow paths. The other end of the valve member is connected by way of a mechanical linkage to an actuator on the outside of the housing to allow an operator to select a desired steam flow rate. A drip tube, disposed on the discharge side of the valve gasket, is provided with a plurality of axial bores. The axial bores in the drip tube communicate with the axial bores in the valve gasket to define a finite number of flow rates. By accurately molding the axial bores in the drip tube somewhat smaller than the axial bores in the valve gasket, the flow rate through the valve can be accurately controlled in spite of tolerances in the fabrication of the valve parts. Also, by utilizing a drip tube on the discharge side of the valve gasket, the valve member is not susceptible to mineral deposits due to spattering resulting from the boiling of water droplets in the steam generator.

DESCRIPTION OF THE DRAWING

These and other objects and advantages of the present invention will become readily apparent upon consideration of the following detailed description and attached drawing, wherein.

DETAILED DESCRIPTION

Figure 1:
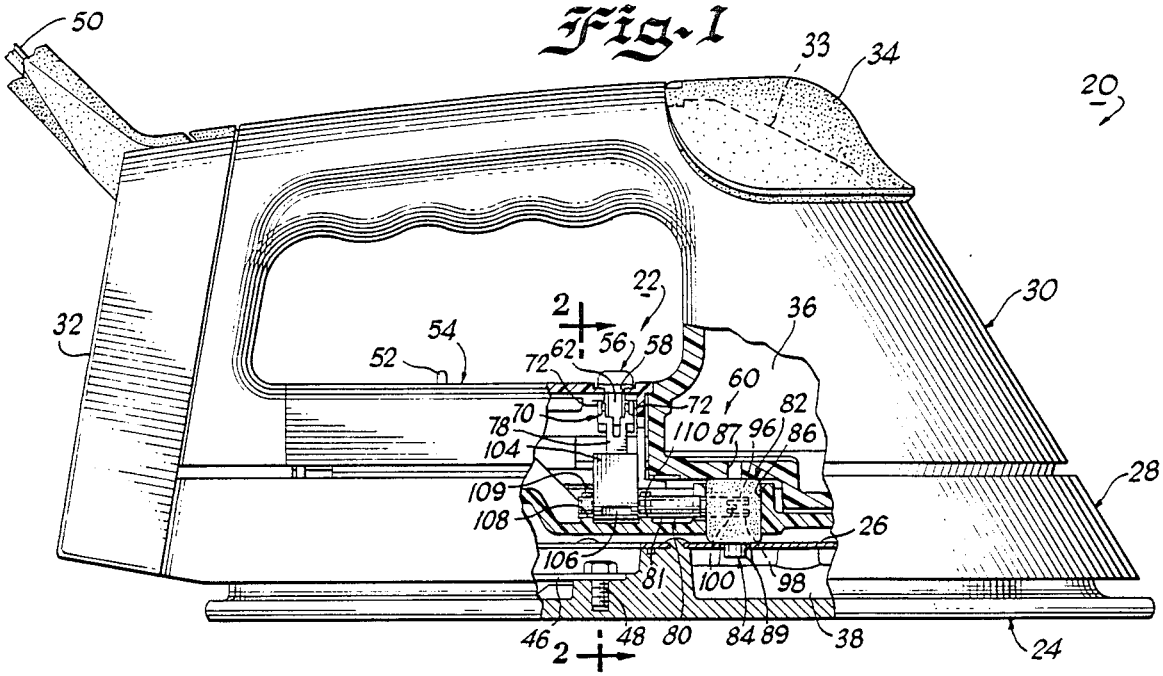
FIG. 1 is a side elevational view of a steam iron partially broken away showing the variable steam flow assembly in accordance with the present invention.
Figure 2:
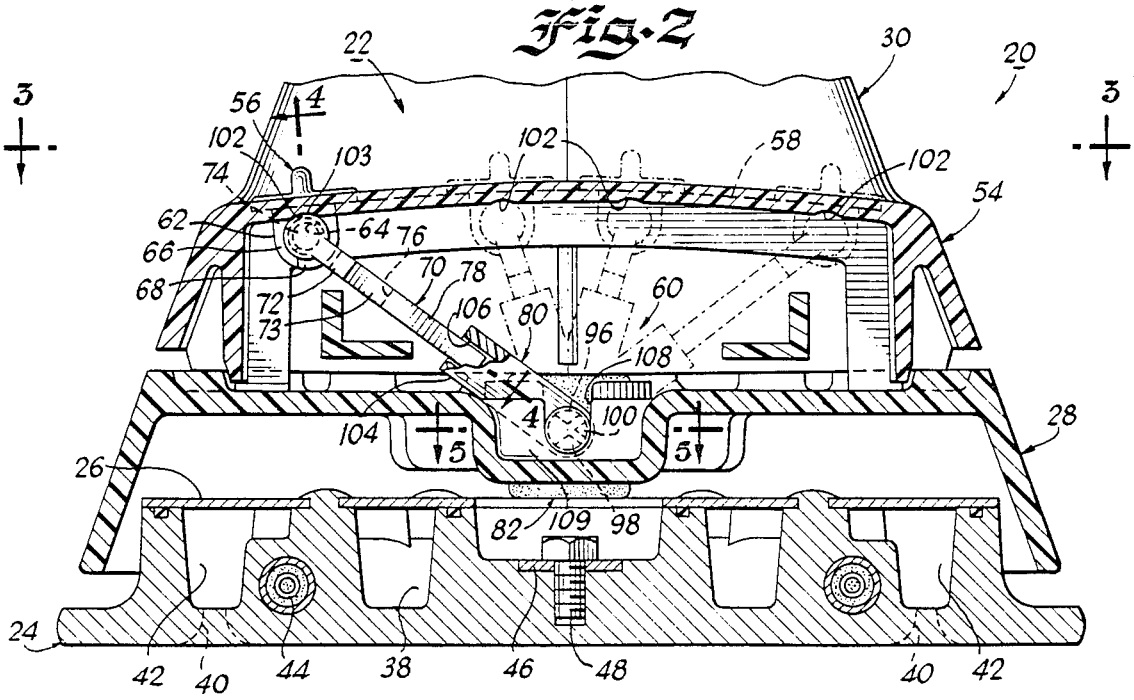
FIG. 2 is a cross-sectional view taken along line 2—2 of FIG. 1.

Referring to FIG. 1, there is shown a steam iron 20 incorporating a variable steam flow assembly 22 in accordance with the present invention. The steam iron 20 includes a soleplate 24 having a steam chamber cover plate 26, a skirt 28, a housing and handle portion 30 and an end cap 32. The housing and handle portion 30 includes a mounted fill funnel 33, integrally formed within the housing and handle portion 30, for filling a water reservoir 36. A fill funnel cover 34 is hingedly mounted to the housing and handle portion 30. The amount of water from the water reservoir metered to a steam generator 38 is controlled by the variable steam flow assembly 22. Steam produced by the steam generator 38 is transported to steam ports 40 on the bottom surface of the soleplate 24 by way of distribution passageways 42.

The steam iron 20, as will be discussed in more detail, is capable of being operated as a dry iron or a steam iron. When steam is desired, the variable steam flow assembly 22 is controlled to allow water from the water reservoir 36 to drip onto the steam generator 38 area of the soleplate 24. The steam generator 38 is heated by a heating element 44 which is controlled by a temperature sensor 46 and attached to the soleplate by a fastener 48. Electric power for the heating element 44 is provided through a power cord 50. The temperature of the steam iron is controlled by a heat control assembly having a temperature control knob 52 mounted on a saddle 54. The saddle 54 is carried by the housing 30. A detailed description of the heat control assembly, as well as other details of the steam iron, are described in detail in copending application Ser. No. 947,019,U.S. Pat. No. 4,748,755 filed on Dec. 29, 1986, which is herein incorporated by reference. The present invention is an improvement upon the steam iron disclosed in the aforesaid copending application by providing a variable steam flow assembly 22. The variable steam flow assembly 22 allows the operator to select various steam flow rates to accommodate various fabrics being ironed.

The variable steam flow assembly 22 of the present invention allows an operator to select from a finite number of flow rates. As shown in FIGS. 2–11, the variable steam flow assembly 22 is shown and will hereinafter be described as having four flow rates including a zero flow rate for when the iron is being used as a dry iron. However, it will be appreciated by those of ordinary skill in the art that the principles of the present invention are generally applicable to steam flow assemblies having various numbers of selectable steam flow rates.

Figure 3:
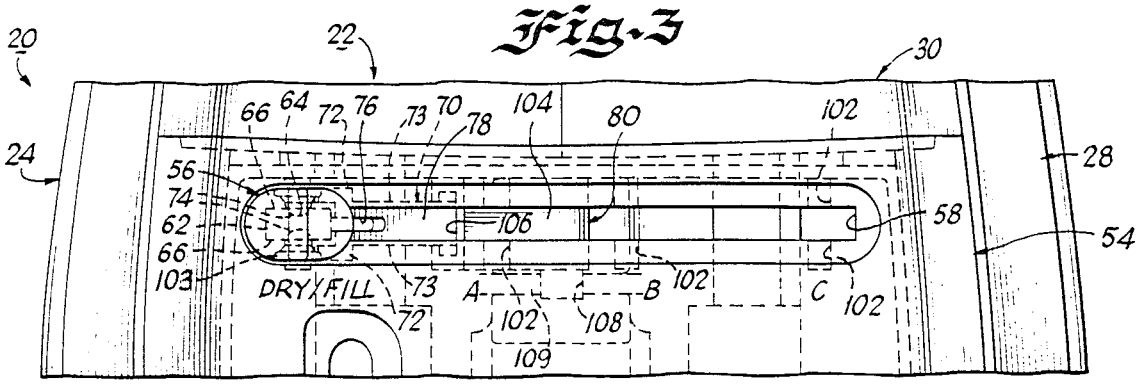
FIG. 3 is a plan elevational view taken along line 3—3 of FIG. 2.
Figure 11:
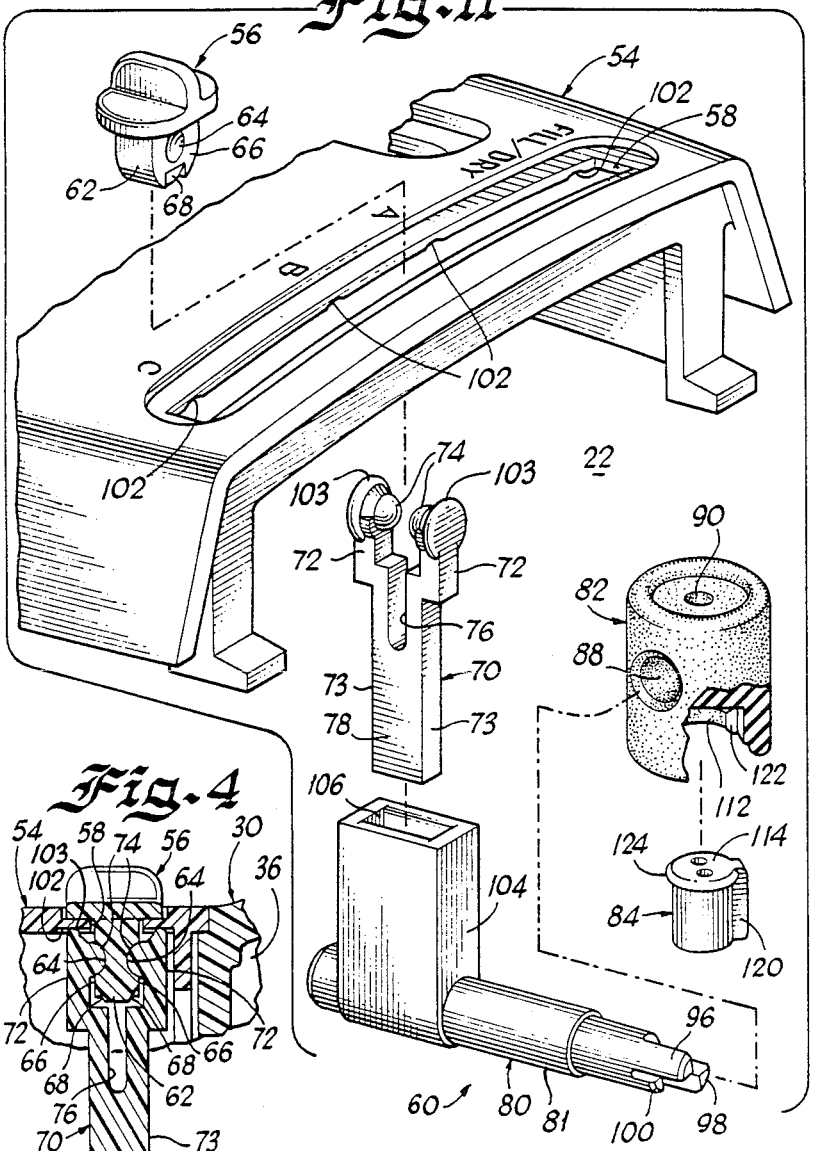
FIG. 11 is an exploded perspective view of of the variable steam flow assembly in accordance with the present invention.

As best shown in FIGS. 3 and 11, the steam flow rate is selected by a control knob 56 located on the saddle 54. The steam flow control knob 56 is slidingly received in an elongated stepped slot 58 which extends generally parallel to the transverse axis of the iron 20. The slot 58 is provided with a predetermined number of detent positions which correspond to a finite number of steam flow rates. For example, as shown best in FIG. 11, four detent positions are shown. At one end of the slot 58, a "DRY/FILL" position is shown which corresponds to a condition when the iron is used dry (e.g., no steam flow). At the other end of the slot 58 is another detent position, labeled "C", which corresponds to a condition of maximum steam flow rate. This position is selected for certain fabrics, such as cotton, which require relatively large amounts of steam for removing wrinkles. Disposed intermediate the ends of the elongated slot are two other detent positions labeled "A" and "B", which correspond to intermediate steam flow rates.

The steam flow control knob 56 is mechanically linked to a novel metering valve, generally designated by the reference numeral 60, forming a portion of the variable steam flow assembly 22. The valve 60 allows the steam flow rates to be relatively accurately controlled and is less susceptible to mineral deposits than steam irons equipped with conventional metering valves.

The steam flow control knob 56 contains a downwardly extending boss 62 with dimples 64 on opposing faces 66 thereof. The boss 62 is also formed with chamfers 68 on opposing faces 66 to facilitate receiving of a control member 70. The control member 70 links the steam flow control knob 56 to the metering valve 60. The control member 70 is an elongated, rectangular member formed with extending arms 72 at one end. The extending arms 72 are offset from a pair of lengthwise extending faces 73 of the control member 70 and are provided with inwardly facing protuberances 74 which are received into the dimples 64 on the boss 62. A slot 76 allows the arms 72 to be separated such that the protuberances 74 can be either inserted or withdrawn from the dimples 64 in the boss 62. The chamfers 68 further facilitate the attachment of the control member 70 to the steam flow control knob 56. The other end of the control arm 70 forms an extending tongue 78 which is mechanically coupled to the metering valve 60.

The metering valve 60 includes a valve member 80, a valve gasket 82 and a drip tube 84. The metering valve 60 provides a predetermined number of flow rates selectable by the operator by controlling the steam flow control knob 56.

The valve gasket 82 is disposed within a bore 86 in the skirt 28 (FIG. 1). The valve 60 including the valve gasket 82 and the drip tube 84 provides the sole communication path between a bore 87 in the water reservoir 36 in the housing 30 and an aperture 89 in the cover plate 26 disposed adjacent the steam generator 38. The valve gasket 82 may be an elongated cylindrical member having a transverse bore 88 which extends partially through the valve gasket 82 (FIG. 11). The transverse bore 88 rotatably receives one end of the valve member 80. The valve gasket 82 is also provided with a plurality of longitudinal bores 90, 92 and 94 which define various separate flow passageways through the valve 60. More particularly, the valve member 80 is received within the transverse bore 88 of the valve gasket 82. The valve member 80 comprises an elongated rod 81 having extending fingers 96, 98 and 100 disposed at one end and being spaced peripherally around the rod 81. The fingers 96 and 98 are longer than the finger 100. These fingers 96, 98 and 100 (as best shown in FIGS. 7–10) are used to close the longitudinal bores 90, 92 and 94 in the valve gasket 82 to establish different flow paths. For example, in FIG. 7, the bores 90, 92 and 94 are closed by the fingers 96 and 98, respectively. The configuration shown in FIG. 7 corresponds to the FILL/DRY position. In this position, no steam is generated. In the next position, identified as the position "A" in FIG. 11, the valve member 80 and its corresponding extending fingers 96, 98 and 100 are shown rotated clockwise from that illustrated in FIG. 7 to the "A" position. In the "A" position, a flow passageway is established between longitudinal bores 90 and 92. In this position, the finger 98 closes the longitudinal bore 94. In the next position illustrated in FIG. 9, which corresponds to the "B" position, the valve member 80 is shown rotated clockwise from the position shown in FIG. 8. In the "B" position, a flow passageway is established through the gasket 82 from the longitudinal bore 90 to the longitudinal bore 94. In the "B" position, the longitudinal bore 92 is closed by the extending finger 100. In the next position illustrated in FIG. 10, which corresponds to the "C" position, the valve member 80 is shown rotated clockwise from that shown in FIG. 9. The "C" position corresponds to the position of maximum flow rate since flow paths are established between all three longitudinal bores 90, 92 and 94.

The four positions illustrated in FIGS. 7–10 are detent positions defined by notches 102 formed on the underside of the elongated stepped slot 58 (FIG. 11). These notches 102 cooperate with rounded portions 103 formed on one end of the extending arms 72 to define the detent positions. Thus, it should be clear that the structure of the metering valve 60 in conjunction with the detent positions define a finite number of flow rates. Furthermore, the flow rates of the metering valve 60 can be more accurately controlled than conventional valves having valve seats and metering rods and are less influenced by tolerances in the parts.

A mechanical linkage which includes the control member 70 and a rectangular portion 104 having an integrally formed rectangular bore 106 allows the control member 80 to be rotated in a clockwise position as the steam flow control knob 56 is moved from the "FILL/DRY" position to the "C" position. As heretofore discussed, these positions correspond to the flow paths illustrated in FIGS. 7–10.

The rectangular portion 104 extends radially from the valve member 80 and has a generally rectangular bore 106. The bore 106 is used to capture the extending tongue portion 78 of the control member 70. The capture assembly simplifies the mechanical linkage between the steam flow control knob 56 and the metering valve 60. The portion of the tongue 78, captured within the slot 106, is dependent upon the position of the steam flow control knob 56 with respect to the elongated stepped slot 58. In the extreme positions (e.g., the FILL/DRY and "C" positions) a relatively small portion of the tongue 78 is captured within the bore 106. In the intermediate positions (e.g., the "A" and "B" positions) a relatively larger portion of the tongue 78 is captured within the rectangular bore 106.

Figure 5:
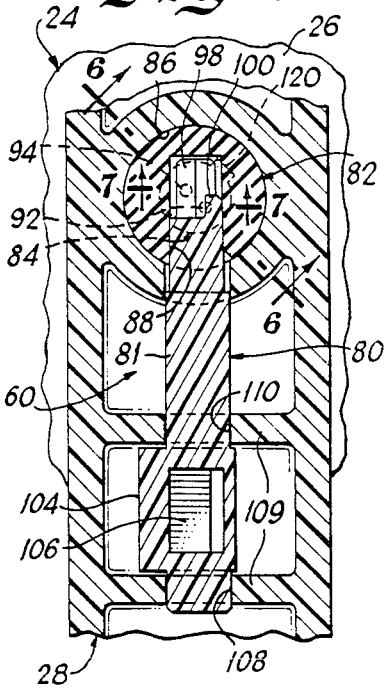
FIG. 5 is a plan sectional view taken along line 5—5 of FIG. 2.
Figure 4:
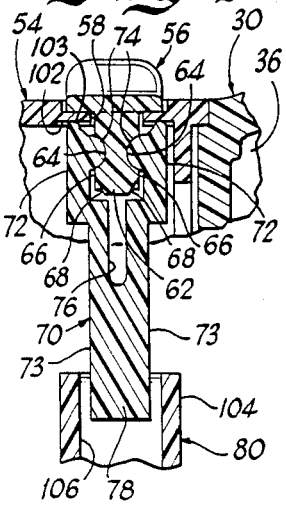
FIG. 4 is a cross-sectional view taken along line 4—4 of FIG. 2.
Figure 6:
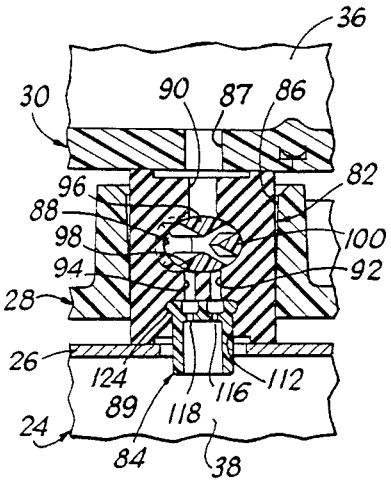
FIG. 6 is a cross-sectional view taken along line 6—6 of FIG. 5.
Figure 7:
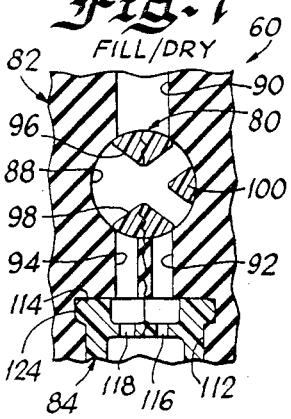
FIG. 7 is an offset sectional view taken along line 7—7 of FIG. 5 of the variable steam flow assembly in accordance with the present invention, shown in the "FILL/DRY" position.
Figure 8:
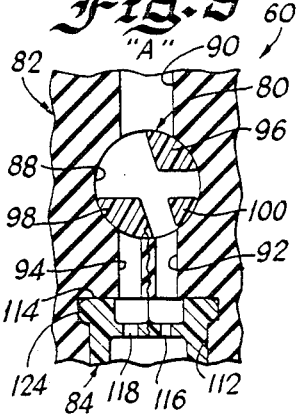
FIG. 8 is an offset sectional view, similar to FIG. 7, illustrating the variable steam flow assembly in the "A" position.
Figure 9:
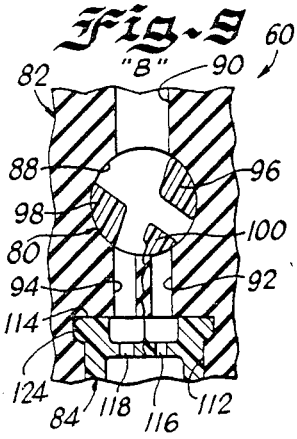
FIG. 9 is an offset sectional view, similar to FIG. 7, illustrating the variable steam flow assembly in the "B" position.
Figure 10:
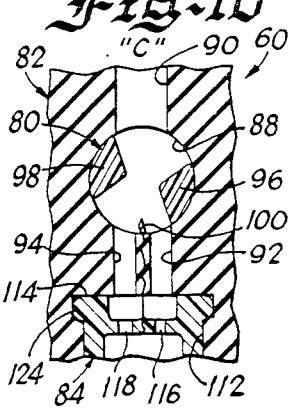
FIG. 10 is an offset sectional view, similar to FIG. 7, illustrating the variable steam flow assembly in the "C" position.

In order to prevent axial movement of the valve member 80, semicircular cradles 108 and 110 are integrally formed in the webbed portions 109 of the skirt 28 (FIG. 5). The cradles 108 and 110 are disposed to receive the rod 81 of the valve member 80 disposed on either side of the rectangular member 104.

The valve gasket 82 is provided with a generally circular bore 112 which extends a predetermined distance from one end of the valve gasket 82. The circular bore 112 is used to receive the drip tube 84. The drip tube 84 is disposed between the steam generator 38 and the metering valve 60 (FIG. 1). The drip tube 84 is used to form water droplets to produce steam in the steam generator 38. The drip tube 84 is comprised of a generally cylindrical hollow member closed at one end 114. The closed end 114 of the drip tube 84 contains two axial bores 116 and 118. As shown best in FIGS. 7–11, these axial bores 116 and 118 are of different diameters and smaller in diameter than the bores 90, 92 and 94 and thus determine the flow rate of the valve 60. By accurately molding the axial bores 116 and 118 in the drip tube 84, the flow rate through the valve 60 can be accurately controlled in spite of tolerances in other valve parts. The axial bores 116 and 118 are aligned with the longitudinal bores 92 and 94 in the valve gasket 82 to allow water to pass from the valve assembly 60 to the drip tube 84.

In order to register the apertures 116 and 118 with the longitudinal bores 92 and 94, a key 120 is provided on the drip tube 84. The key 120 cooperates with a keyway 122 formed within the valve gasket 82 to register the apertures 116 and 118 with the longitudinal bores 92 and 94, respectively, in the valve gasket 82.

The drip tube 84 is also provided with an annular lip 124. The diameter of the annular lip 124 is slightly greater than the circular bore 112 provided on the bottom side of the valve gasket 82. Thus, when the drip tube 84 is inserted into the circular bore 112, the valve gasket 82 deforms slightly to receive the annular lip and consequently returns to its undeformed position to snugly hold the drip tube 84 in place. Since the drip tube 84 separates the valve member 80 from the steam generator 38, the possibility of any mineral deposits forming on the valve member 80 due to spattering resulting from boiling water droplets in the steam generator 38 is greatly reduced.

Thus, it should be apparent that a unique, variable steam flow assembly has been disclosed for an iron. There are many ways in which this system can be implemented, all of which are contemplated to be within the scope of the appended claims.

What is claimed and desired to be secured by Letters Patent is:

1. A variable steam flow iron comprising:

a soleplate having a plurality of steam discharge ports;

a steam generator in communication with said steam discharge ports having a water inlet port;

a heating element disposed in said soleplate to heat said steam generator;

a housing which includes a water reservoir at least partially located above said steam generator having a discharge port in communication with said water inlet port of said steam generator and a fill port; and means for controlling the amount of water flow from the water reservoir to the steam generator which includes a valve disposed between said water inlet port of said steam generator and said discharge port of said housing, said valve having a plurality of flow passageways selectable by a single valving member to provide a plurality of rates of water flow from said water reservoir to said steam generator.

2. A variable steam flow iron as recited in claim 1 wherein said controlling means includes a mechanical linkage coupled between said valving member and an actuator on the exterior of said housing.

3. A variable steam flow iron comprising:

a soleplate having a plurality of steam discharge ports;

a steam generator in communication with said steam discharge ports having a water inlet port;

a heating element disposed in said soleplate to heat said steam generator;

a housing which includes a water reservoir at least partially located above said steam generator having a discharge port in communication with said water inlet port of said steam generator and a fill port; and means for controlling the amount of water flow from the water reservoir to the steam generator which includes a valve disposed between said water inlet port of said steam generator and said discharge port of said housing, said valve having a plurality of flow passageways selected by a single valving member to provide a plurality of rates of water flow from said water reservoir to said steam generator; said valving member being rotatably mounted with respect to said housing about an axis generally perpendicular to the direction of water flow through the valve.

4. A variable steam flow iron as recited in claim 3 wherein said soleplate forms a portion of said steam generator.

5. A variable steam flow iron as recited in claim 3 wherein said valving member is an elongated member carried by the housing in an axially fixed manner.

6. A variable steam flow iron as recited in claim 3 further including a drip tube coupled between said controlling means and said steam generator water inlet port.

7. A variable steam flow iron comprising:

a soleplate having a plurality of steam discharge ports;

a steam generator in communication with said steam discharge ports having a water inlet port;

a heating element disposed in said soleplate to heat said steam generator;

a housing which includes a water reservoir at least partially located above said steam generator having a discharge port in communication with said water inlet port of said steam generator and a fill port; and means for controlling the amount of water flow from the water reservoir to the steam generator which includes a valve disposed between said water inlet port of said steam generator and said discharge port of said housing, said valve having a plurality of flow passageways selected by a single valving member to provide a plurality of rates of water flow from said water reservoir to said steam generator; said valve including:

a gasket having a plurality of orifices defining a plurality of flow passageways through the gasket; and a valving member in communication with said passageways for selecting the flow passageways through the gasket.

8. A variable steam flow iron as recited in claim 7 wherein said gasket has a generally cylindrical shape.

9. A variable steam flow iron as recited in claim 8 wherein said flow passageways through said gasket are generally parallel to its longitudinal axis.

10. A variable steam flow iron as recited in claim 8 wherein said cylindrical gasket is mounted such that its longitudinal axis is generally perpendicular to the soleplate.

11. A variable steam flow iron as recited in claim 8 wherein said gasket is formed with a transverse bore disposed intermediate the ends of said gasket for receiving said valving member.

12. A variable steam flow iron as recited in claim 11 wherein said gasket is provided with one or more axial bores between one end of said gasket and said transverse bore.

13. A variable steam flow iron as recited in claim 11 wherein said gasket is provided with one or more bores between one end of said gasket and said transverse bore and one or more bores between the other end of said gasket and said transverse bore defining a plurality of flow passageways through said gasket generally parallel to the longitudinal axis of said gasket.

14. A variable steam flow iron as recited in claim 13 wherein said bores are provided with different diameters.

15. A variable steam flow iron as recited in claim 14 wherein bores between the transverse bore and said one end or said other end have the same diameter.

16. A variable steam flow iron as recited in claim 15 wherein one bore is provided between said one end and said transverse bore and a plurality of bores is provided between said transverse bore and said other end.

17. A variable steam flow iron as recited in claim 13 wherein one of said one end or said other end of said gasket includes means for receiving a drip tube.

18. A variable steam flow iron as recited in claim 17 wherein said receiving means further includes means for registering said drip tube with respect to said gasket.

19. A variable steam flow iron as recited in claim 18 wherein said registering means includes a keyway.

20. A variable steam flow iron as recited in claim 12 wherein said gasket is provided with one or more axial bores between said other end of said gasket and said transverse bore.

21. A variable steam flow iron comprising:

a soleplate having a plurality of steam discharge ports;

a steam generator in communication with said steam discharge ports having a water inlet port;

a heating element disposed in said soleplate to heat said steam generator;

a housing which includes a water reservoir at least partially located above said steam generator having a discharge port in communication with said water inlet port of said steam generator and a fill port;

means for controlling the amount of water flow from the water reservoir to the steam generator which includes a valve disposed between said water inlet port of said steam generator and said discharge port of said housing, said valve having a plurality of flow passageways selected by a single valving member to provide a plurality of rates of water flow from said water reservoir to said steam generator; and a drip tube coupled between said controlling means and said steam generator water inlet port;

said drip tube being generally a hollow cylinder closed at one end, having a plurality of orifices disposed on said closed end which are adapted to communicate with said ports in said valve.

22. A variable steam flow iron comprising:

a soleplate having a plurality of steam discharge ports;

a steam generator in communication with said steam discharge ports having a water inlet port;

a heating element disposed in said soleplate to heat said steam generator;

a housing which includes a water reservoir at least partially located above said steam generator having a discharge port in communication with said water inlet port of said steam generator and a fill port; and means for controlling the amount of water flow from the water reservoir to the steam generator which includes a valve having a plurality of flow passageways selectable by a rotatable valve member to provide a plurality of rates of water flow from said water reservoir to said steam generator.

23. A variable steam flow iron as recited in claim 22 wherein said valve member is an elongated member carried by the housing in an axially fixed manner.

24. A variable steam iron as recited in claim 23 wherein said valve member is formed with a plurality of peripherally spaced fingers at one end which are used to selectively open and close said flow passageways in said valve.

25. A variable steam flow iron comprising:

a soleplate having a plurality of steam discharge ports;

a steam generator in communication with said steam discharge ports having a water inlet port;

a heating element disposed in said soleplate to heat said steam generator;

a housing which includes a water reservoir at least partially located above said steam generator having a discharge port in communication with said water inlet port of said steam generator and a fill port;

means for controlling the amount of water flow from the water reservoir to the steam generator which includes a valve having a plurality of flow passageways selectable by a rotatable valve member to provide a plurality of rate of water flow from said water reservoir to said steam generator; wherein said valve member is an elongated member carried by the housing in an axially fixed manner; said valve member being rotatable about an axis generally perpendicular to the water flow through the valve.

26. A variable steam flow iron comprising:

a soleplate having a plurality of steam discharge ports;

a steam generator in communication with said steam discharge ports having a water inlet port;

a heating element disposed in said soleplate to heat said steam generator;

a housing which includes a water reservoir at least partially located above said steam generator having a discharge port in communication with said water inlet port of said steam generator and a fill port; and means for controlling the amount of water flow from the water reservoir to the steam generator which includes a valve having a manifold with a plurality of ports and a valve member, rotatably mounted about an axis generally parallel to the plane of the soleplate.

27. A variable steam flow iron comprising:

a soleplate having a plurality of steam discharge ports;

a steam generator in communication with said steam discharge ports having a water inlet port;

a heating element disposed within said steam generator;

a housing which includes a water reservoir at least partially located above said steam generator having a discharge port in communication with said water inlet port of said steam generator and a fill port; and means for controlling the amount of water flow from the water reservoir to the steam generator which includes a valve having a manifold with a plurality of ports and valve member for selecting said ports, said valve member movable about an axis generally perpendicular to the water flow through the valve.

* * * * *